US007658181B2

(12) United States Patent
Dickenscheid

(10) Patent No.: US 7,658,181 B2
(45) Date of Patent: Feb. 9, 2010

(54) DELIVERY DEVICE FOR DELIVERING FUEL OUT OF A FUEL TANK

(75) Inventor: Lothar Dickenscheid, Ockenheim (DE)

(73) Assignee: Siemens Aktiengesellschaft, Munich (DE)

( * ) Notice: Subject to any disclaimer, the term of this patent is extended or adjusted under 35 U.S.C. 154(b) by 299 days.

(21) Appl. No.: 11/719,501

(22) PCT Filed: Oct. 10, 2005

(86) PCT No.: PCT/EP2005/055117

§ 371 (c)(1),
(2), (4) Date: May 16, 2007

(87) PCT Pub. No.: WO2006/053803

PCT Pub. Date: May 26, 2006

(65) Prior Publication Data

US 2009/0064973 A1 Mar. 12, 2009

(30) Foreign Application Priority Data

Nov. 17, 2004 (DE) ..... 10 2004 055 442

(51) Int. Cl.
*F02M 37/04* (2006.01)
*F02M 37/08* (2006.01)

(52) U.S. Cl. ..... 123/509; 137/572

(58) Field of Classification Search ..... 123/509, 123/514, 506; 137/571, 572, 574, 576, 565.22, 137/564.5; 417/194
See application file for complete search history.

(56) References Cited

U.S. PATENT DOCUMENTS 4,778,354 A 10/1988 Idei ..... 417/366
5,070,849 A * 12/1991 Rich et al. ..... 123/509
5,330,475 A 7/1994 Woodward et al. ..... 417/89
5,607,293 A 3/1997 Luedtke ..... 417/423.7
6,075,300 A 6/2000 Moss et al. ..... 310/136
6,155,793 A 12/2000 Tuckey et al. ..... 417/87
6,273,131 B1 8/2001 Kleppner ..... 137/565.22
6,450,151 B1 * 9/2002 Frank et al. ..... 123/514
6,457,945 B2 10/2002 Kleppner et al. ..... 417/84
6,640,789 B2 11/2003 Gabauer et al. ..... 123/509
6,988,491 B2 1/2006 Burhenne et al. ..... 123/509

FOREIGN PATENT DOCUMENTS

DE 761245 2/1953
DE 1272432 7/1968
DE 2650146 A1 5/1977
DE 19549192 A1 7/1997
DE 19915255 A1 10/2000
DE 10026749 A1 4/2001

(Continued)

*Primary Examiner*—Mahmoud Gimie
(74) *Attorney, Agent, or Firm*—King & Spalding L.L.P.

(57) ABSTRACT

A delivery device for delivering fuel out of a fuel tank (1) has a suction connection (13) of a fuel pump (3) connected to a mixing tube (11) of a sucking jet pump (6). The sucking jet pump (6) sucks fuel out of the fuel tank (1) via a foot valve (12). The mixing tube (11) has an overflow valve (17) that controls a connection to a swirl pot (2). This enables the fuel pump (3) to suck fuel out of the fuel tank (1) when the swirl pot (2) is empty.

18 Claims, 1 Drawing Sheet

FOREIGN PATENT DOCUMENTS

| | | | |
|---|---|---|---|
| DE | 19961923 | A1 | 7/2001 |
| DE | 10028458 | A1 | 12/2001 |
| DE | 10138838 | A1 | 3/2003 |
| DE | 10231616 | A1 | 1/2004 |
| EP | 0959242 | B1 | 8/2003 |
| WO | 9525885 | | 9/1995 |

* cited by examiner

DELIVERY DEVICE FOR DELIVERING FUEL OUT OF A FUEL TANK

CROSS-REFERENCE TO RELATED APPLICATIONS

This application is a U.S. national stage application of International Application No. PCT/EP2005/055117 filed Oct. 10, 2005, which designates the United States of America, and claims priority to German application number 10 2004 055 442.0 filed Nov. 17, 2004, the contents of which are hereby incorporated by reference in their entirety.

TECHNICAL FIELD

The invention relates to a delivery device for delivering fuel out of a fuel tank to an internal combustion engine of a motor vehicle, with a fuel pump, with a swirl pot which has a foot valve, and with a sucking jet pump, with a suction connection of the sucking jet pump being connected to the fuel tank.

BACKGROUND

Delivery devices of this type are frequently used in motor vehicles nowadays and are known from practice. In this case, the fuel pump generally delivers fuel out of the swirl pot to the internal combustion engine via a forward flow line. The sucking jet pump is supplied with fuel as the working fluid via fuel recycled by the internal combustion engine or via a branch of the forward flow line. The sucking jet pump serves to deliver fuel out of the fuel tank into the swirl pot. However, the sucking jet pump only starts to deliver when fuel can be delivered out of the swirl pot by the fuel pump.

A disadvantage of the known delivery device is that, during initial filling or during refilling after the fuel tank has been completely emptied, a large quantity of fuel has to be placed into the fuel tank so that the swirl pot is likewise filled. Only then can the fuel pump suck up fuel and operate the sucking jet pump. If the bottom of the fuel tank has a very large area, filling for the first time requires several liters of fuel. In practice, it has been shown that, for filling for the first time, a filling level of 18 mm is required in the fuel tank so that the fuel pump can suck up fuel.

SUMMARY

Hence, there exists a need of minimizing the quantity of fuel required for the filling for the first time.

According to an embodiment, a delivery device for delivering fuel out of a fuel tank to an internal combustion engine of a motor vehicle, may comprise a fuel pump having a first suction connection, and a sucking jet pump having a second suction connection connected to the fuel tank, and having a mixing tube directly connected to the first suction connection.

BRIEF DESCRIPTION OF THE DRAWINGS

The invention permits numerous embodiments. To further clarify its basic principle, one of these is illustrated in the drawing and is described below. In the drawing

DETAILED DESCRIPTION

Figure 1:
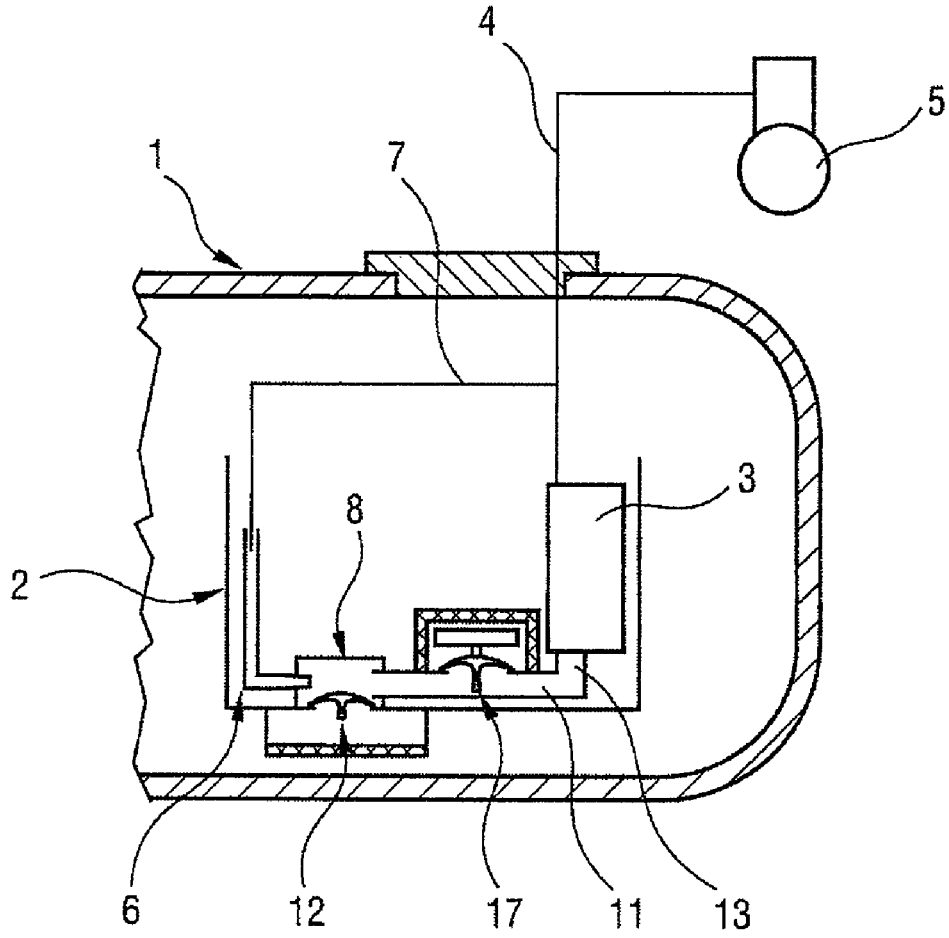
FIG. 1 shows, schematically, a sectional illustration through a fuel tank with a delivery device according to an embodiment.

The configuration according to an embodiment makes it possible, after filling for the first time, for the fuel pump to immediately suck fuel out of the fuel tank via the suction connection of the sucking jet pump and the mixing tube. The suction pressure when the fuel pump is switched on is sufficient for this. The sucking jet pump does not need to be operated for this. As soon as the fuel pump has built up a sufficient pressure and supplies fuel, the sucking jet pump is also supplied with fuel as the working fluid. In practice, it has been shown that, with the delivery device according to an embodiment, a filling height of 3 mm in the fuel tank is sufficient for delivery of fuel.

According to another embodiment, idle running of the swirl pot can be avoided in a simple manner if the foot valve is arranged in the suction connection of the sucking jet pump and is movable into the open position by a negative pressure in the suction connection of the sucking jet pump in relation to the pressure at the bottom of the fuel tank, and is movable into the closed position when there is equilibrium of pressure.

When the fuel tank is empty, the fuel pump is capable of directly sucking fuel out of the swirl pot if an overflow valve leading into the swirl pot is arranged in a connection of the mixing tube to the swirl pot.

The controlling of the overflow valve as a function of the filling level in the swirl pot turns out to be particularly simple, according to another embodiment, if the overflow valve has a float arranged in the swirl pot and is switchable into the open position by the float above a designated filling level in the swirl pot and is switchable into the closed position below the designated filling level.

According to another embodiment, the connection of the swirl pot to the suction connection of the fuel pump is opened even at low filling levels in the swirl pot if the float of the overflow valve is arranged in the vicinity of the bottom of the swirl pot. This ensures that, when the fuel tank is empty, virtually all of the fuel can be sucked out of the swirl pot by the fuel pump.

If, during normal operation, the sucking jet pump delivers more fuel than the fuel pump uses, the filling of the swirl pot is reliably ensured, according to another embodiment, if the overflow valve is designed as a pressure control valve which opens when the mixing tube contains a high pressure in relation to the pressure in the bottom region of the swirl pot. By this means, excess fuel which is delivered by the sucking jet pump flows into the swirl pot via the overflow valve.

According to another embodiment, the optional guiding of fuel delivered by the sucking jet pump and flowing in via the foot valve to the fuel pump requires a particularly low outlay on design if a mixing chamber is arranged in the bottom region of the swirl pot, if the mixing chamber has a nozzle of the sucking jet pump and a connection for the mixing tube of the sucking jet pump, and if the foot valve leads into the mixing chamber.

The overflow valve could be arranged, for example, likewise on the mixing chamber. A sucking of fuel out of the swirl pot by the sucking jet pump can be prevented in a simple manner, according to another embodiment, if the overflow valve is arranged on the mixing tube.

According to another embodiment, the foot valve and/or the overflow valve are capable of controlling momentarily large flow cross sections if the foot valve and/or the overflow valve have/has a plate-like component covering an opening. A further advantage of this configuration is that the foot valve or the overflow valve thereby requires a particularly small construction space.

According to another embodiment, the guiding of the plate-like component of the foot valve and/or of the overflow valve requires a particularly small structural outlay if the plate-like component is connected to a guide stem.

When the fuel tank is empty, sucking up of air by the sucking jet pump can be avoided in a simple manner if the foot valve is covered by a fine-mesh filter element. Fine-mesh filter elements of this type permit fuel to pass through, but block or restrict the passage of air, and are generally known in delivery devices for fuel. As a rule, fine-mesh filter elements of this type also have a Teflon coating. Furthermore, when the fuel tank is empty, sucking up of air is avoided by designing the sucking jet pump to have low power. An appropriately low-powered sucking jet pump is not capable of sucking up air.

According to another embodiment, admission of dirt into the mixing tube can be avoided in a simple manner if the overflow valve is covered by a fine-mesh filter element. The filter element therefore likewise permits only fuel to flow through it and, if the overflow valve leaks or if the swirl pot is empty, prevents air from penetrating the mixing tube.

The overall height of the delivery device according to an embodiment is reduced if the sucking jet pump is arranged next to the fuel pump.

FIG. 1 shows a fuel tank 1 in a sectional illustration with a swirl pot 2 arranged therein. A fuel pump 3 which delivers fuel via a forward flow line 4 to an internal combustion engine 5 of a motor vehicle is arranged in the swirl pot 2. Furthermore, a sucking jet pump 6 which is supplied with fuel as the working fluid via a branch 7 connected to the forward flow line 4 is arranged in the swirl pot 2.

Figure 2:
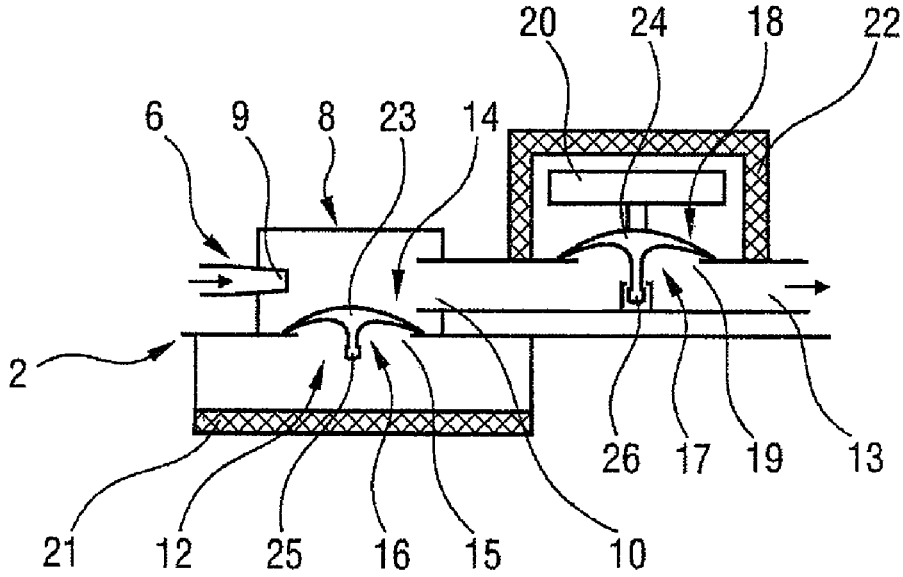
FIG. 2 shows, on a greatly enlarged scale, a partial region of the delivery device from FIG. 1.

The sucking jet pump 6 has a nozzle 9 leading into a mixing chamber 8 and is illustrated on a greatly enlarged scale in FIG. 2. The mixing chamber 8 has a connection 10 for a mixing tube 11, and a foot valve 12. The mixing tube 11 leads to the fuel pump 3 illustrated in FIG. 1. The flow end of the mixing tube 11 therefore forms a suction connection 13 of the fuel pump 3. The foot valve 12 has a valve body 14 which closes or releases an opening 15 in the bottom of the swirl pot 2. The opening 15 in the bottom of the swirl pot 2 therefore forms a suction connection 16 of the sucking jet pump 6. The mixing tube 11 has an overflow valve 17 which, by means of a valve body 18, closes or releases an opening 19 leading to the swirl pot 2. The valve body 18 of the overflow valve 17 is connected to a float 20. The foot valve 12 and the overflow valve 17 are each covered by a fine-mesh filter element 21, 22. The valve bodies 14, 18 of the overflow valve 17 and of the foot valve 12 each have a plate-like component 23, 24 and a guide stem 25, 26 which is connected to the plate-like component 23, 24 and by means of which the movement of the plate-like component 23, 24 is guided. In the simplest case, the valve bodies 14, 18 are each entirely manufactured from a rubber-elastic material and, in the inoperative position, close the particular opening 15, 19 and, when there is appropriate differential pressure, are moved away from the opening 15, 19. In addition, the overflow valve 17 is moved into the open position by the float 20 when there is an appropriate filling level in the swirl pot 2.

When the fuel pump 3 illustrated in FIG. 1 delivers fuel out of the mixing tube 11 into the forward flow line 4, fuel passes via the branch 7 to the sucking jet pump 6. The sucking jet pump 6 sucks up fuel via the foot valve 12 and delivers it in the mixing tube 11 to the fuel pump 3. The fuel pump 3 can therefore suck up fuel when the swirl pot 2 is empty and when there is a very low quantity of fuel in the fuel tank 1. If more fuel is delivered by the sucking jet pump 6 than the fuel pump 3 uses, excess fuel passes through the overflow valve 17 into the swirl pot 2. In addition, when the swirl pot 2 is sufficiently filled, the float 20 moves the overflow valve 17 into the open position. The fuel pump 3 can therefore also suck fuel out of the swirl pot 2. The fine-mesh filter elements 21, 22 are coated, for example, with Teflon and are permeable exclusively to fuel and prevent air from passing through them.

What is claimed is:

1. A delivery device for delivering fuel out of a fuel tank to an internal combustion engine of a motor vehicle, comprising a fuel pump, a swirl pot which has a foot valve, and a sucking jet pump, wherein a suction connection of the sucking jet pump is connected to the fuel tank, a suction connection of the fuel pump is connected directly to a mixing tube of the sucking jet pump, and an overflow valve in connection between the mixing tube into the swirl pot.

2. The delivery device according to claim 1, wherein the foot valve is arranged in the suction connection of the sucking jet pump and is movable into the open position by a negative pressure in the suction connection of the sucking jet pump in relation to the pressure at the bottom of the fuel tank, and is movable into the closed position when there is equilibrium of pressure.

3. The delivery device according to claim 1, wherein the overflow valve has a float arranged in the swirl pot and is switchable into the open position by the float above a designated filling level in the swirl pot and is switchable into the closed position below the designated filling level.

4. The delivery device according to claim 3, wherein the float of the overflow valve is arranged in the vicinity of the bottom of the swirl pot.

5. The delivery device according to claim 1, wherein the overflow valve is designed as a pressure control valve which opens when the mixing tube contains a high pressure in relation to the pressure in the bottom region of the swirl pot.

6. The delivery device according to claim 1, wherein a mixing chamber is arranged in the bottom region of the swirl pot, in that the mixing chamber has a nozzle of the sucking jet pump and a connection for the mixing tube of the sucking jet pump, and in that the foot valve leads into the mixing chamber.

7. The delivery device according to claim 1, wherein the overflow valve is arranged on the mixing tube.

8. The delivery device according to claim 1, wherein the foot valve and/or the overflow valve have/has a plate-like component covering an opening.

9. The delivery device according to claim 8, wherein the plate-like component is connected to a guide stem.

10. The delivery device according to claim 1, wherein the foot valve is covered by a fine-mesh filter element.

11. The delivery device according to claim 1, wherein the overflow valve is covered by a fine-mesh filter element.

12. The delivery device according to claim 1, wherein the sucking jet pump is arranged next to the fuel pump.

13. A delivery device for delivering fuel out of a fuel tank to an internal combustion engine of a motor vehicle, comprising:

a fuel pump having a first suction connection, a sucking jet pump having a second suction connection connected to the fuel tank, and having a mixing tube directly connected to the first suction connection, a swirl pot, and an overflow valve arranged in connection between the mixing tube and the swirl pot.

14. The delivery device according to claim 13, wherein the swirl pot includes a foot valve.

15. The delivery device according to claim 14, wherein the foot valve is arranged in the suction connection of the sucking jet pump and is movable into the open position by a negative pressure in the suction connection of the sucking jet pump in relation to the pressure at the bottom of the fuel tank, and is movable into the closed position when there is equilibrium of pressure.

16. The delivery device according to claim 13, wherein the overflow valve has a float arranged in the swirl pot and is switchable into the open position by the float above a designated filling level in the swirl pot and is switchable into the closed position below the designated filling level.

17. The delivery device according to claim 13, wherein the float of the overflow valve is arranged in the vicinity of the bottom of the swirl pot.

18. The delivery device according to claim 17, wherein the overflow valve is designed as a pressure control valve which opens when the mixing tube contains a high pressure in relation to the pressure in the bottom region of the swirl pot.

* * * * *